US005347717A

United States Patent [19]

Ts'ai

[11] Patent Number: 5,347,717

[45] Date of Patent: Sep. 20, 1994

[54] CHUCK ASSEMBLY FOR A DISPOSABLE RAZOR

[76] Inventor: Tse-Jen Ts'ai, No. 178, Lane 415, Kuang Fu South Road, Taipei, Taiwan

[21] Appl. No.: 147,313

[22] Filed: Nov. 5, 1993

[51] Int. Cl.[5] ..... B26B 21/16

[52] U.S. Cl. ..... 30/89; 30/50; 30/51

[58] Field of Search ..... 30/50, 51, 85, 87–89, 30/57

[56] References Cited

U.S. PATENT DOCUMENTS 4,428,116 1/1984 Chen et al. ..... 30/87
4,488,357 12/1984 Jacobson ..... 30/87 X
4,492,025 1/1985 Jacobson ..... 30/87
4,797,998 1/1989 Motta ..... 30/87
5,157,834 10/1992 Chen et al. ..... 30/50 X

FOREIGN PATENT DOCUMENTS 2226973 7/1990 United Kingdom ..... 30/86

*Primary Examiner*—Douglas D. Watts
*Attorney, Agent, or Firm*—Morton J. Rosenberg; David I. Klein

[57] ABSTRACT

The chuck assembly includes a chucking device having two pawls controlled by a press rod to move toward each other for loading a blade cartridge, a spring worked to return the pawl to its former position after the loading of the blade cartridge permitting the blade cartridge to be retained to the pawls, and a spring-supported balance rod on which the loaded blade cartridge is balanced.

5 Claims, 5 Drawing Sheets

CHUCK ASSEMBLY FOR A DISPOSABLE RAZOR

BACKGROUND OF THE INVENTION

The present invention relates to disposable razors, and more particularly relates to a blade cartridge chuck assembly for a disposable razor.

A normal disposable razor is generally comprised of a handle having a blade cartridge chuck controlled by two opposite press buttons to hold a blade cartridge. As the chuck is controlled by the two opposite buttons, it is not convenient to operate with a single hand. Further, this double-button chuck control mechanism is complicated, which greatly increases the cost of the razor.

SUMMARY OF THE INVENTION

It is one object of the present invention to provide a blade cartridge chuck assembly for a disposable razor which can be conveniently operated with a single hand. It is another object of the present invention to provide a blade cartridge chuck assembly for a disposable razor which is inexpensive to manufacture.

To achieve the aforesaid objects, there is provided a chuck assembly comprises a chucking device having two pawls controlled by a press rod to move toward each other for loading a blade cartridge, a spring worked to return the chucking device to its former position after the loading of the blade cartridge permitting the blade cartridge to be retained to the pawls, and a spring-supported balance rod on which the loaded blade cartridge is balanced.

DETAILED DESCRIPTION OF THE PREFERRED EMBODIMENTS

Figure 1:
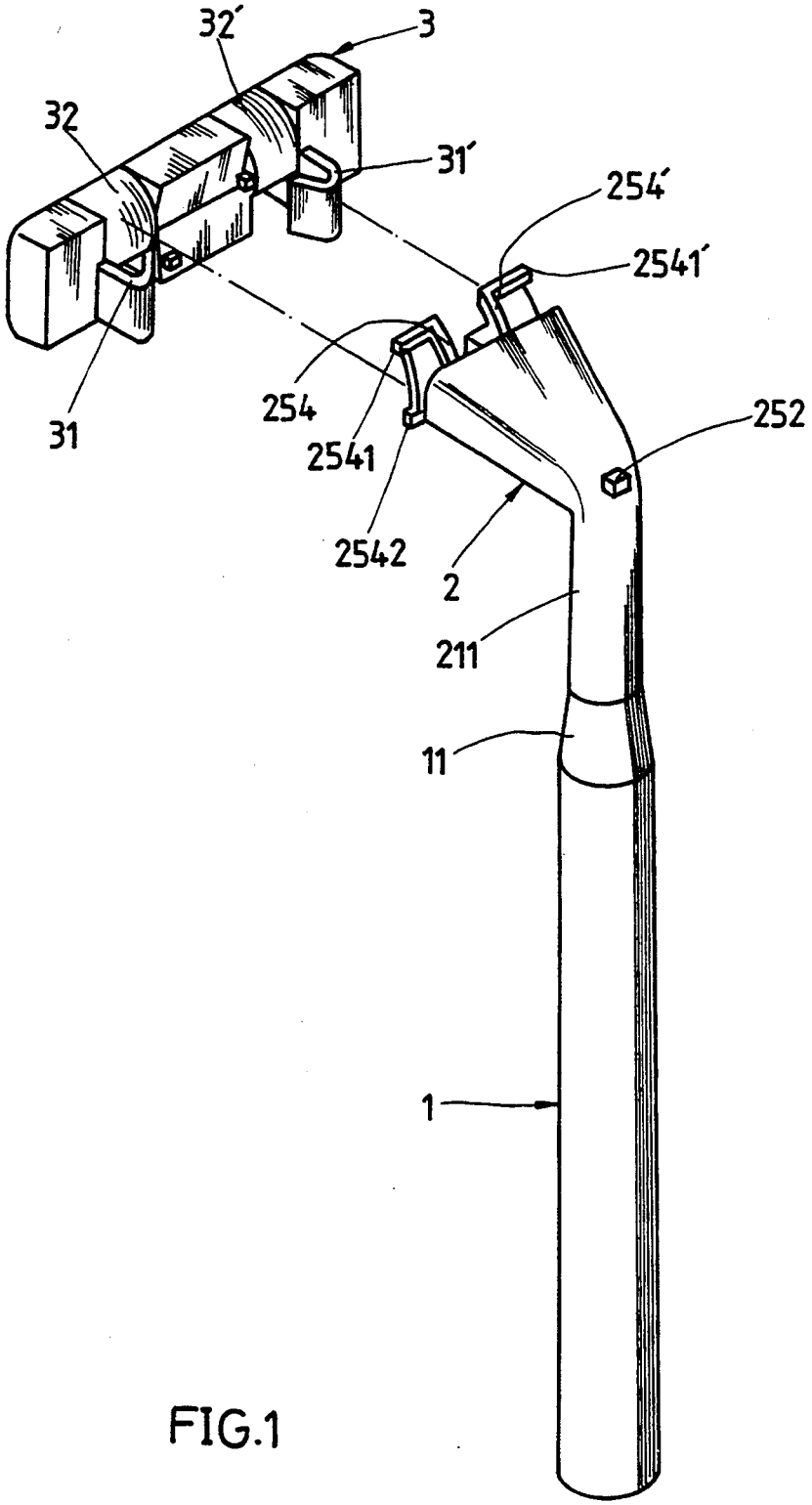
FIG. 1 shows a disposable razor according to one embodiment of the present invention.
Figure 2:
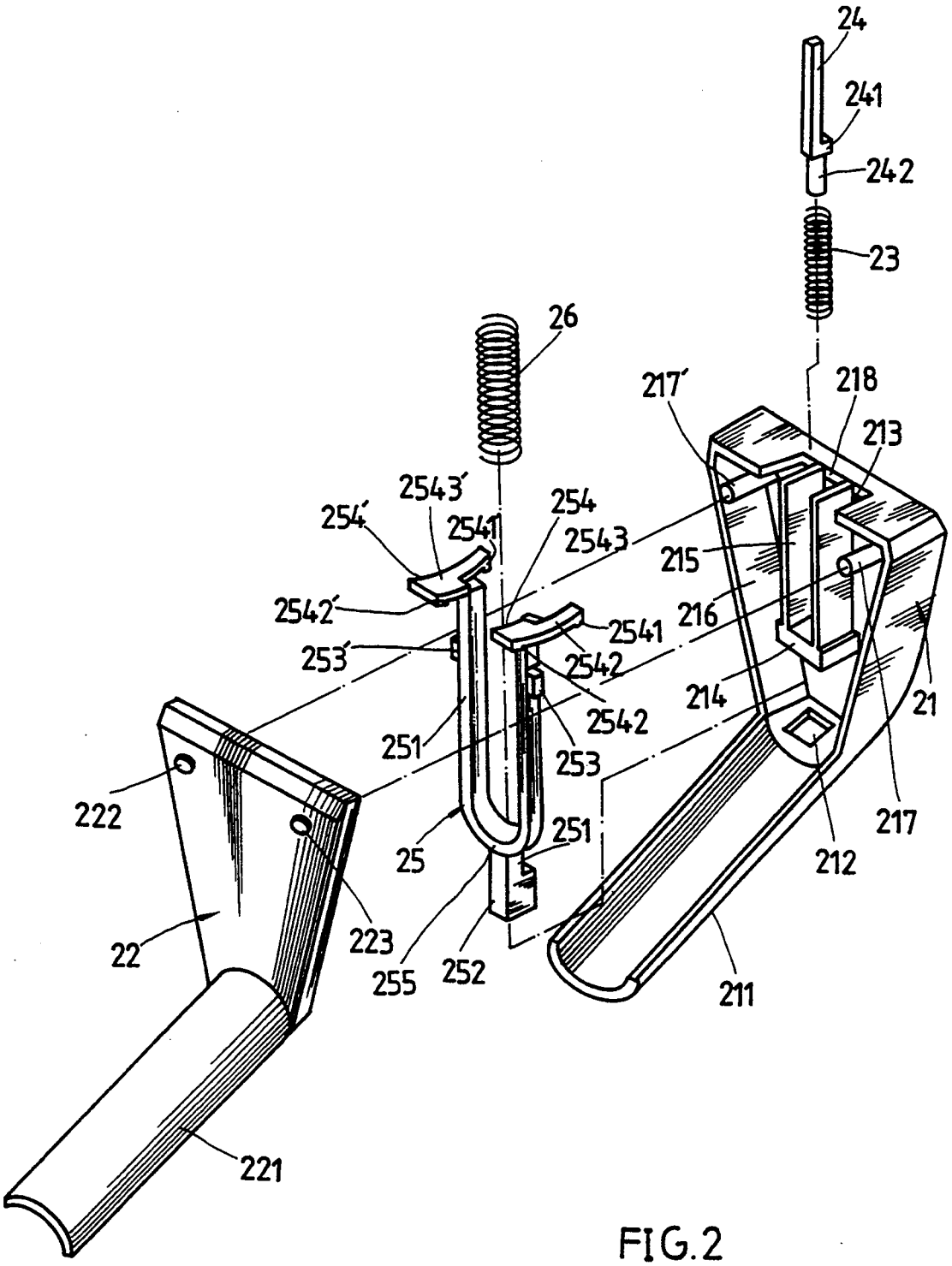
FIG. 2 is an exploded view the chuck assembly of the disposable razor of FIG. 1.
Figure 3:
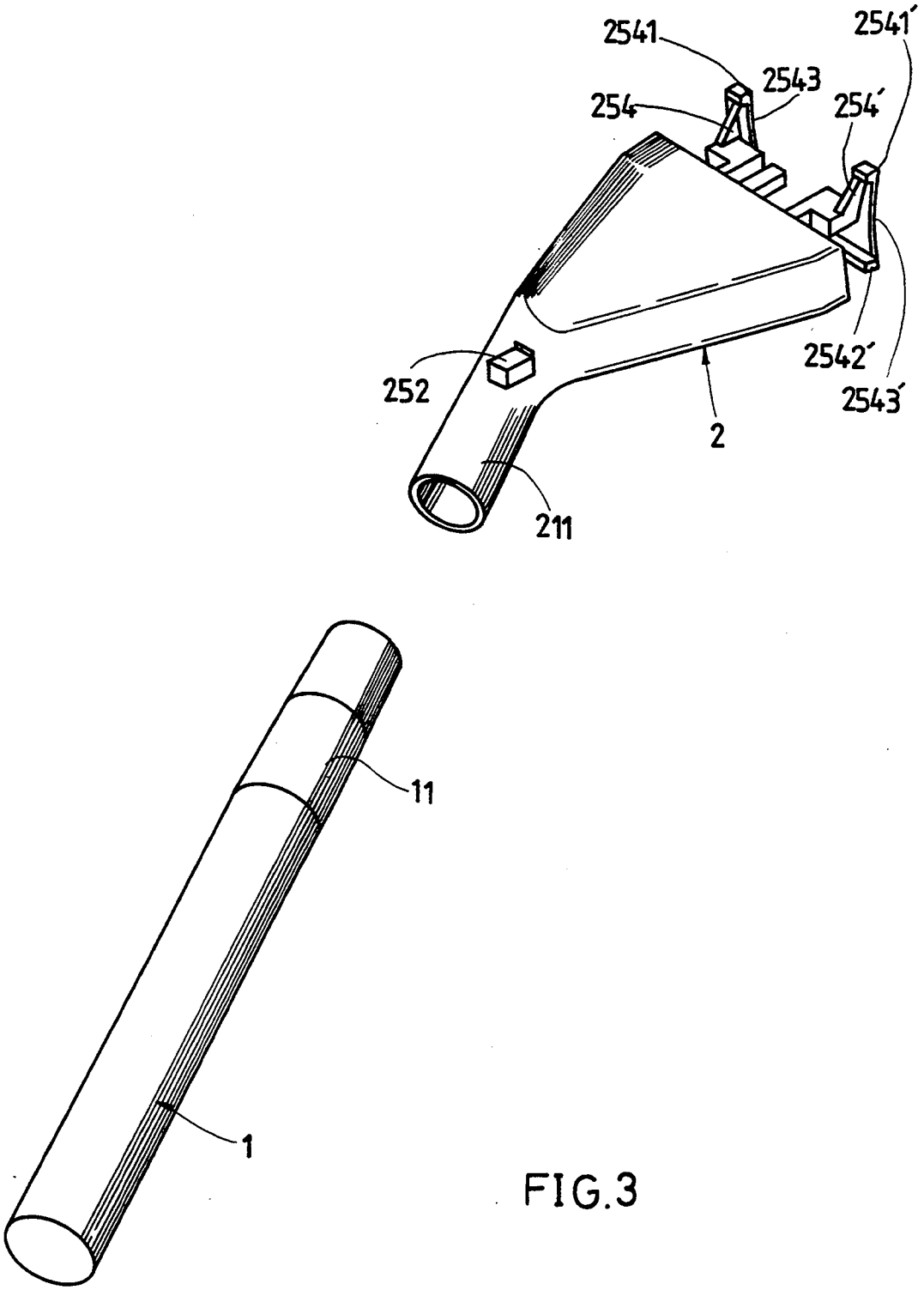
FIG. 3 shows the chuck assembly detached from the handle of the disposable razor of FIG. 1.

Referring to FIGS. 1, 2, and 3, a disposable razor in accordance with the present invention is generally comprised of a handle 1, and a chuck assembly 2 fastened to the connecting tube 11 on one end of the handle 1 to hold a blade cartridge 3.

The chuck assembly 2 is comprised of a housing formed of a top shell 21 and a bottom shell 22, and a chucking device 25 fastened to the housing. The top shell 21 comprises a connecting rod 211 extended from the rear end thereof at right angles, a button hole 212 on the rear end, a front opening 213 on the front wall 218 thereof, a substantially U-shaped frame 214 on the inside defining a first chamber 215 within the U-shaped frame 214 and a second chamber 216 outside the U-shaped frame 214, two posts 217;217' disposed within the second chamber 216. A first compression spring 23 is fastened inside the first chamber 215 to support a rod 24. The rod 24 comprises a projecting block 241 pushed by the first compression spring 23 to stop against the front wall 218 of the top shell 21 on the inside, and a rear extension 242 inserted into the first compression spring 23. The chucking device 25 is fastened to the top shell 25 on the inside to hold the blade cartridge 3 outside the top shell 25. The chucking device 25 comprises a U-shaped rod 251 disposed within the second chamber 216 around the U-shaped frame 214, a press rod 252 extended from the U-shaped rod 251 and inserted through the button hole 212 out of the top shell 21, two bevel blocks 253 bilaterally projected from the U-shaped rod 251 and respectively stopped against the front wall 218 of the top shell 21 on the inside, two outward pawls 254;254' horizontally extended from the two opposite ends of the U-shaped rod 251 and disposed outside the top shell 21 and controlled to hold the blade cartridge 3. Each outward pawl 254;254' comprises an arched wall 2543;2543' surrounded by a front flange 2541;2541' and a rear flange 2542;2542'. There is provided a second spring 26 stopped between the U-shaped rod 251 of the chucking device 25 and the U-shaped frame 214 of the top shell 21. The bottom shell 22 fits over the top shell 21, comprising a connecting rod 221 matched with the connecting rod 211 of the top shell 21 and then connected to the connecting tube 11 of the handle 1. The bottom shell 22 further comprises two pin holes 222;223', which receives the posts 217;217'. After the top shell and bottom shells 21;22 are connected together with the posts 217;217' respectively fitted into the pin holes 222;223, they are sealed together through a high-frequency heat sealing process. The blade cartridge 3 comprises two hooks 31;31' on the back side thereof, and two arched wall portions 32;32' spaced within the hooks 31;31'.

Figure 4:
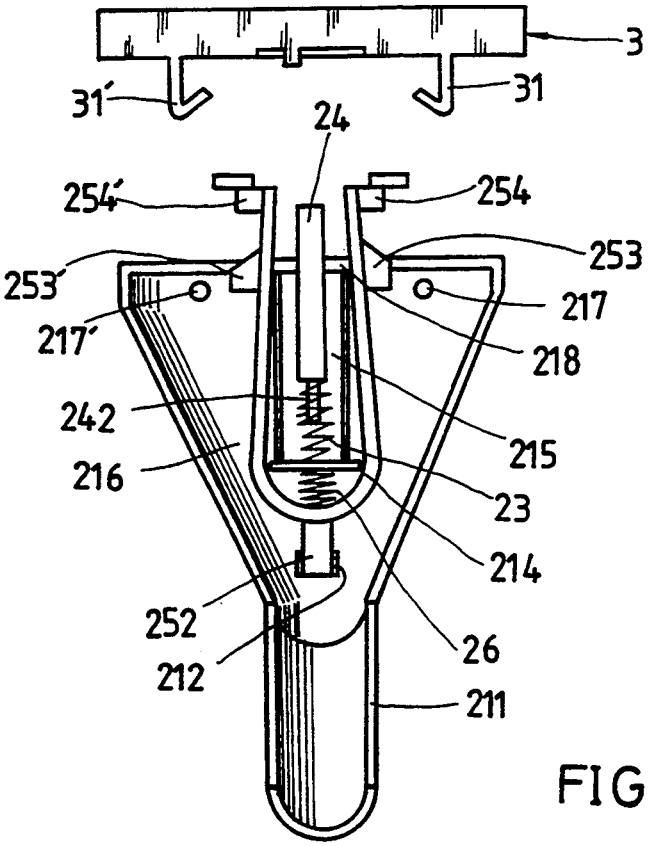
FIG. 4 is a sectional view of the chuck assembly of FIG. 2 before the connection of the blade cartridge.
Figure 5:
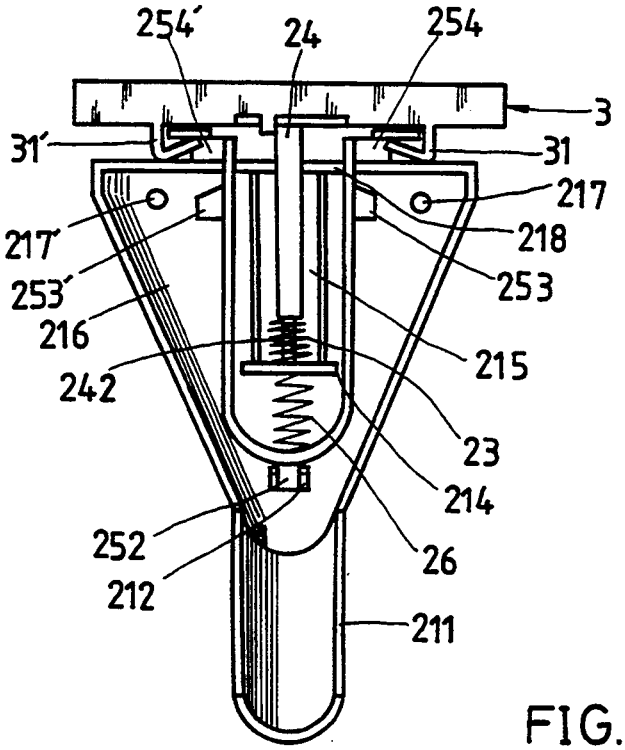
FIG. 5 is a sectional view of the chuck assembly of FIG. 2 after the connection of the blade cartridge.

Referring to FIGS. 4 and 5 and FIG. 3 again, when the handle 1 is held in the hand, the press rod 252 is pressed with the thumb to move the U-shaped rod 251 forwards. Because the bevel blocks 253;253' are stopped against the front wall 218 of the top shell 21, moving the U-shaped rod 251 forwards causes the U-shaped rod 251 to be squeezed inwards to move the pawls 254;254' toward each other, and therefore the pawls 254;254' can be inserted into the space defined between the hooks 31;31'. As the thumb is released from the press rod 252, the second spring 26 immediately moves the chucking device 25 back to its former position, causing the the pawls 254;254' to extend outwards from each other, and therefore the pawls 254;254' become respectively engaged with the hooks 31;31'. When clamped, the blade cartridge 3 is balanced on the rod 24; the arched walls 2543;2543 respectively fit over the arched wall portions 32;32' ; the front and rear flanges 2541;2541;2542;2542 limit the movement of the hooks 31 on the pawls 254;254' for permitting the blade cartridge 3 to be oscillated back and forth on the chucking device 25 within a fixed angle.

Figure 6:
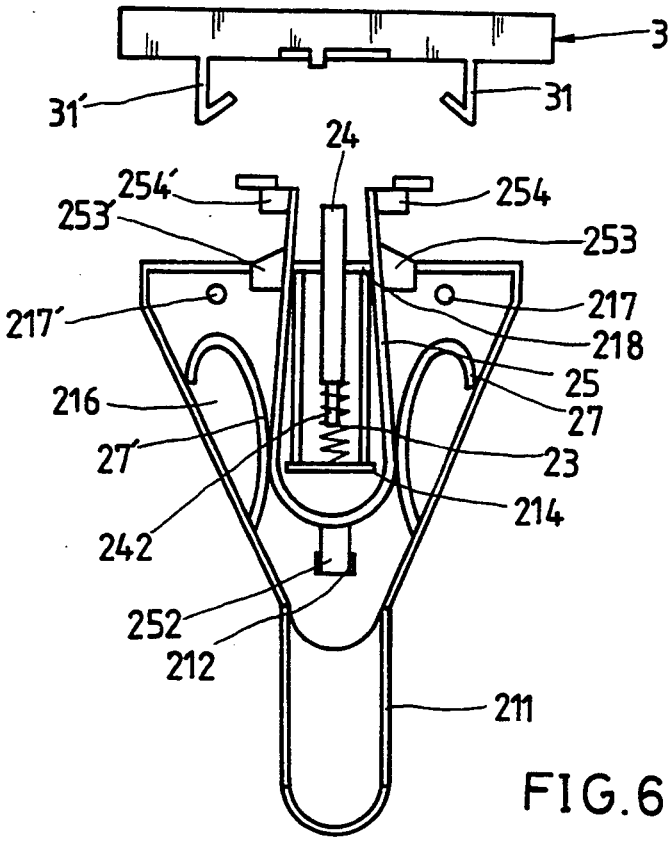
FIG. 6 is a sectional view of an alternative form of the chuck assembly according to the present invention before the connection of the blade cartridge.
Figure 7:
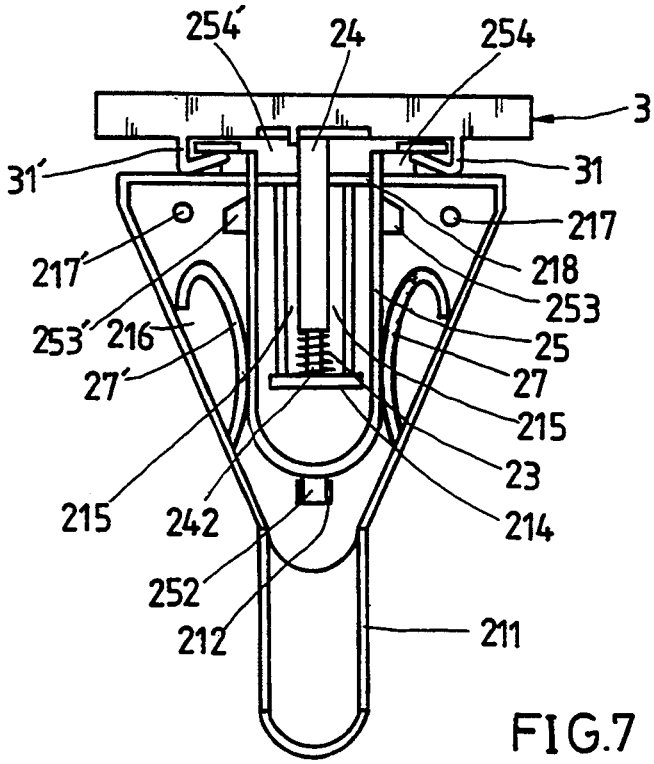
FIG. 7 is another sectional view of the chuck assembly of FIG. 6 showing the blade cartridge loaded.

While only one embodiment of the present invention has been shown and described, it will be understood that various modifications and changes could be made without departing from the spirit and scope of the invention. For example: two plates springs 27;27' may be fastened inside the second chamber 216 to retain chucking device 25, as shown in FIGS. 6 and 7, instead of the installation of the compression spring, namely, the second spring 26.

What is claimed is:

1. A chuck assembly fastened to a handle to hold a blade cartridge, comprising:

a housing formed of a bottom shell and a top shell covered on said bottom shell, said bottom shell comprising two mounting holes; said top shell comprising a button hole on the rear end, a front opening on a front wall thereof, a substantially U-shaped frame on the inside defining a first chamber inside said U-shaped frame and a second chamber outside said U-shaped frame, two posts disposed within said second chamber and respectively fitted into said mounting holes on said bottom shell;

a chucking device retained inside said housing to hold a blade cartridge outside said housing, said chucking device comprising a press rod extended out of said button hole, a U-shaped rod connected to said press rod and disposed inside said second chamber around said U-shaped frame, two symmetrical pawls disposed on two opposite ends of said U-shaped rod and extended out of said housing through said front opening, two bevel blocks projected from said U-shaped rod on two opposite sides and respectively stopped at said front wall of said top shell inside said housing;

first spring means fastened inside said housing to retain said chucking device in position; and wherein when said press rod is pressed, said bevel blocks are moved forwards and rubbed against said front wall, causing said pawls moved toward each other for loading said blade cartridge on said pawls permitting said blade cartridge to be retained to said pawls after said press rod is released from the pressure and said chucking device is moved back to its former position by said first spring means.

2. The chucking assembly of claim 1 wherein said blade cartridge comprises two hooks spaced on a back wall thereof and respectively engaged with said pawls when loaded.

3. The chuck assembly of claim 1 further comprising second spring means fastened inside said first chamber, and a balance rod supported on said second spring means to balance the blade cartridge being loaded on said pawls.

4. The chuck assembly of claim 1 wherein said first spring means is a compression spring retained between the U-shaped rod of said chucking device and the U-shaped frame of said top shell.

5. The chuck assembly of claim 1 wherein said first spring means comprises two curved plate springs bilaterally disposed inside said second chamber and retained between the U-shaped rod of said chucking device and two opposite lateral walls of said top shell.

* * * * *